United States Patent [19]

Wentzell

[11] Patent Number: 4,610,719

[45] Date of Patent: Sep. 9, 1986

[54] METHOD OF AN APPARATUS FOR MAKING METAL POWDER

[75] Inventor: Joseph M. Wentzell, Remsen, N.Y.

[73] Assignee: Nyby Uddeholm Powder AB, Torshalla, Sweden

[21] Appl. No.: 779,311

[22] Filed: Sep. 24, 1985

Related U.S. Application Data

[63] Continuation of Ser. No. 694,434, Jan. 24, 1985, abandoned.

[30] Foreign Application Priority Data

Jan. 25, 1984 [DE] Fed. Rep. of Germany ..... 3402500

[51] Int. Cl.[4] ..... B22D 23/08; B05B 17/00

[52] U.S. Cl. ..... 75/0.5 C; 264/12; 425/6

[58] Field of Search ..... 75/0.5 C, 0.5 B; 264/5, 264/12; 425/6

[56] References Cited

U.S. PATENT DOCUMENTS 3,049,421 8/1962 Allen et al. ..... 75/0.5 B
3,165,396 1/1965 Goon ..... 75/0.5 B
3,510,546 5/1970 Wentzell ..... 264/13
3,588,071 6/1971 Wentzell ..... 425/6
4,040,815 8/1977 Francois et al. ..... 75/0.5 B

FOREIGN PATENT DOCUMENTS 1285098 12/1968 Fed. Rep. of Germany .

*Primary Examiner*—Wayland Stallard
*Attorney, Agent, or Firm*—Pahl, Lorusso & Loud

[57] ABSTRACT

An apparatus and a method destined for the production of metal powder, wherein inert gas, especially argon is admixed to a metal melt rising in a riser, thereby forming a metal froth which is pressurized likewise by inert gas, especially argon of high pressure in a pulverization chamber, at the same time, forming metal droplets. These are displaced from the pulverization chamber by the gas blown into the same, to enter an expansion chamber in the form of a collecting vessel, the metal droplets being accelerated in the passage from the pulverization chamber to the collecting vessel, at the same time, forming the finest metal powder.

12 Claims, 1 Drawing Figure

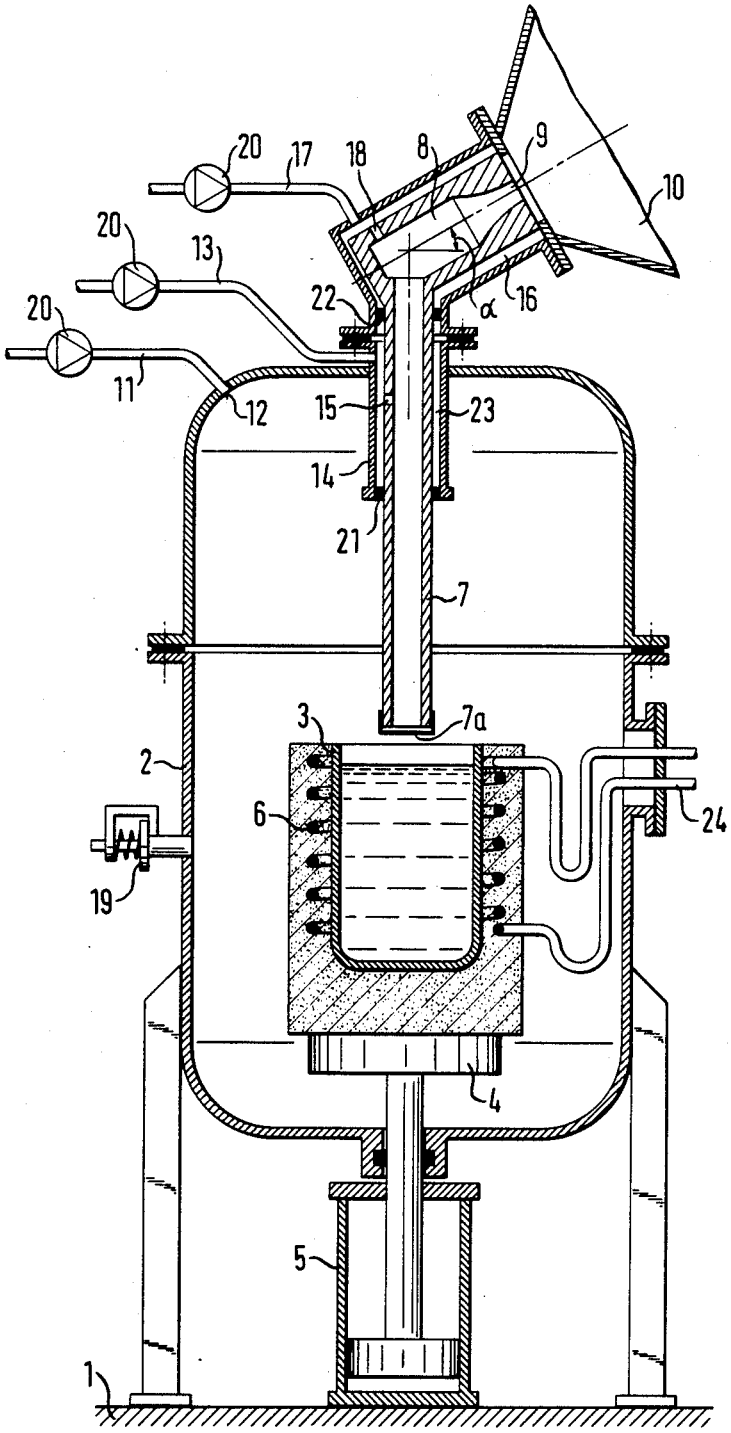
20
17
18
8
9
10
20
13
22
α
16
20
11
12
15
23
14
21
7
3
7a
2
6
24
19
4
5
1

METHOD OF AN APPARATUS FOR MAKING METAL POWDER

This application is a continuation of Ser. No. 694,434, filed Jan. 24, 1985, and now abandoned.

The instant invention relates to a method of and an apparatus for making metal powder by atomizing a metal melt out of a riser.

Metal powder is becoming ever more important in the production of metal objects, especially objects of complex shape. For this reason a corresponding great number of proposals have been made of a method and an apparatus to produce metal powder. The known solutions are complicated and expensive both as regards the method and the apparatus. Furthermore, the energy demand is quite high with the known methods and apparatus. In particular, the known methods and apparatus do not guarantee a constant quality of the metal powder.

A method and apparatus of the kind mentioned initially are known from DE-AS No. 1 285 098 serving, in the first place, to make small metal balls such as needed for ball point pens, ball bearings, and the like. The known solution provides for an upright uptake or riser to be immersed in a metal melt and caused to rotate about its longitudinal axis. The metal melt rising in the riser or uptake channel is propelled away through passages starting from a central uptake channel at the upper end of the riser and extending approximately radially outwardly. At the same time, solidifying droplets are formed of the melt.

Is an object of the instant invention to provide a method and an apparatus of the kind specified initially by means of which metal powder of the highest, constant quality can be produced at minimum expenditure as to structure, process, and energy requirements.

This object is met, in accordance with the invention, by the characterizing measures of claim 1 as regards the method and by the characterizing features of claim 6 as regards the apparatus.

In accordance with the invention the production of metal powder starts from a metal or metal alloy melt, and the whole process takes place in a closed environment, preferably in inert gas, especially argon. The metal powder produced by the method and apparatus according to the invention is characterized by maximum homogeneity, not only in composition and texture but also in shape and size of the metal particles.

Preferably, the metal melt is mixed with gas, preferably inert gas, at the same time, forming a metal froth which is "blown up" or divided into fine metal droplets, in part still hollow, by being subjected to an inert pressure gas in a pulverization chamber. The inert pressure gas, preferably argon at the same time serves to press the metal droplets from the pulverization chamber through a mouthpiece which preferably converges in the direction of flow into a closed expansion chamber, namely a collecting vessel. Hereby a so-called secondary separation or dispersion of the metal droplets takes place, yielding even finer, fully solid particles. During the secondary separation any hollow or hollowed out metal droplets still present will burst. Moreover, the metal droplets are really torn apart by the great acceleration they experience in the converging mouthpiece. In the expansion chamber or collecting vessel in which the pressure is much lower than in the upstream pulverization chamber consequently the finest, entirely solid metal powder will deposit. This metal powder may be used to produce articles of maximum inherent stability.

The invention thus also ensures that no metal particles with cavities are formed. It should be noted here, as a precaution, that the term "metal" as used also includes metal alloys, especially stainless steel alloys and superalloys.

Advantageous further developments of the method and apparatus according to the invention are specified in the method and apparatus sub-claims, respectively, to which express reference is made. The measures according to claims 4 and 8, respectively, should be mentioned specifically here. The metal particles experience great acceleration in the range of the passage from the pulverization chamber to the expansion chamber or collecting vessel by the external pressure gas flow This is similar to the acceleration caused by the convergingly narrowing mouthpiece according to claim 7. Both measures may be combined and this will have the advantage that the acceleration in the area of the passage mentioned is variable by the outer "accelerating stream" in response to the desired degree of the secondary distribution. The outer pressure gas stream in the area of the passage from the pulverization chamber to the collecting vessel preferably is a flow which is of uniform strength at the periphery of the passage and approximately parallel to the wall. The pressure gas used preferably likewise is an inert gas, especially argon.

The invention will be described further, by way of example, with reference to the accompanying drawing which shows a preferred embodiment of the apparatus according to the invention.

A melting pot 3 for holding a metal or metal alloy melt is arranged in a closed receptacle 2 which is gas tight all around and placed on a stable support. Above the melting pot 3 a riser 7 leads out of the receptacle 7. The melting pot 3 may be elevated by a hydraulically or hydropneumatically or even a mechanically driven means inside the receptacle 2 to such a level that the riser 7 becomes immersed in the metal melt. The lifting means 5 is connected to a lifting platform 4 on which the melting pot 3 is secured. The riser 7 is closed at its lower end facing the metal melt by a caplike cover 7*a* which is destroyed as the riser 7 dips into the metal melt. A means 6 for generating the required melting heat is associated with the melting pot 3. With the embodiment shown this is an induction coil of known structure having its electrical terminals passed out of the receptacle 2 (plug-type connection 21). A gas pressure pipe 11 opens into the receptacle 2, the open end being designated by reference numeral 12. Gas, especially inert gas such as argon may be introduced into the the receptacle through the gas pressure pipe 11 to produce an internal pressure in the receptacle by which the metal melt is pressed up in the riser 7 when the latter is immersed in the metal melt. The gas pressure inside the receptacle 2 acts on the free surface of the metal melt. The receptacle 2 is provided with a safety valve 19 so as to make sure that no inadmissibly high gas pressure is built up inside the receptacle 2.

The riser 7 passes out of the receptacle 2 through a sleeve 14 disposed in the cover of the receptacle 2. The inner diameter of the sleeve 14 is greater than the outer diameter of the riser 7 and the annular space 23 thus formed between the riser 7 and the sleeve 14 is sealed off from the interior of the receptacle 2 on the one hand (annular seal 21) and from the exterior surroundings on the other hand (annular seal 22). A gas pressure pipe 13 opens into the annular space 23. An inert gas, preferably argon can be admixed to the metal melt rising in the riser (at correspondingly high gas pressure in the interior of the receptacle 2) through the gas pressure pipe into the annular space 23 and from the annular space through an aperture 15 in the riser 7. The metal melt thus leaves the riser as a metal froth. The annular space 23 functions as a gas steadying zone.

A so-called pulverization chamber 8 is connected to the upper end of the riser 7 located outside the receptacle 2. An inert gas, namely argon may be blown at high pressure into the pulverization chamber through an opening 18. The pulverization chamber 8 is surrounded by an annular space 16 sealed off from the outside, in a manner similar to the upper part of the riser 7. A gas pressure pipe 17 opens into the annular space 16 which serves as a gas steadying zone, just like the annular space 23. The gas pressure pipes 11, 13, and 17 each comprise gas pressure regulating valves 20 so that the pressure of the gas introduced through these pipes can be harmonized individually. The introduction of non-reactive or inert pressure gas into the pulverization chamber 8 causes atomization or separation of the metal froth into metal droplets still of relatively large volume and sometimes also hollow in small part. The pressure gas introduced into the pulverization chamber 8 at the same time serves to blow the metal droplets through a convergingly narrowing passage 9 into an expansion chamber, i.e. a low pressure space, namely a closed collecting vessel 10. At the same time, the finest fully solid metal powder is formed. The converging constriction of the passage 9 and the resulting acceleration of the gas metal droplet flow from the pulverization chamber 8 into the collecting vessel 10 are of very essential significance. As explained above, this acceleration also may be achieved by an outer annular flow.

The great accelerating forces caused by the acceleration in the passage 9 and acting on the metal droplets actually tear apart the metal droplets, whereby an extremely fine metal powder is produced.

In the embodiment shown the convergingly narrowing passage 9 is directed obliquely upwardly at an angle $\alpha$ of about 45° with respect to the horizontal level. The longitudinal axis of the passage 9 coincides with the longitudinal axis of the pulverization chamber 8. The convergingly narrowing passage 9 may be designed as an exchangeable mouthpiece. In this manner passages 9 of different degrees of convergence may be selected as the insert in a corresponding mouthpiece, irrespective of the gas pressures selected and the metal alloy used. If the acceleration in the passage 9 is effected by the outer annular flow mentioned, the degree of acceleration may be varied by influencing the annular flow accordingly. Then preferably both measures are applied, namely an outer annular flow and a converging mouthpiece. This may make an exchange of the mouthpiece superfluous if the outer annular flow is varied corrrespondingly.

The mouthpiece also may be mounted to be pivotable so that the optimum angle $\alpha$ is adjustable individually.

In order to produce metal powder by the apparatus shown and described, first the melting pot 3 filled with a metal melt is placed on the lifting platform 4 within the induction coil 6. The induction coil 6 ensures that the metal in the melting pot 3 does remain in molten condition. The receptacle 2 then is closed to be gas tight before being filled with argon through the gas pressure pipe 11 and the opening 12. Then the lifting means 5 is used to raise the lifting platform 4 and thus the melting pot 3 including the melt to such a level that the riser 7 will dip into the metal melt by its lower end. This causes destruction of the covering cap 7*a*. The gas pressure inside the receptacle 2 acting on the free surface of the melt causes the same to be pressed upwardly through the riser 7. At the same time a non-reactive gas, like argon is admixed to the rising melt through the gas pressure pipe 13, the annular space 23, and the aperture 15 in the upper range of the riser 7. Hereby metal froth is formed. The metal froth enters the pulverization chamber 8 into which likewise a pressurized gas is blown through the opening 18 thus causing atomization or dispersion of the metal froth into metal droplets. The gas blown into the pulverization chamber 8 also blows the metal droplets through the convergingly narrowing passage 9 into a collecting vessel 10, at the same time, forming the finest fully solid metal particles. Any hollow or hollowed out metal droplets which may be formed in the pulverization chamber 8 really burst in the passage 9 and disintegrate into the finest metal particles by virtue of the partial pressure differentials within and without the metal droplet cavities. The collecting vessel 10 is closed gas tight with respect to the outside.

As explained above, the convergingly narrowing passage is of quite essential importance for the fine atomization. Also, the gas consumption may be reduced considerably by virtue of the converging passage.

The convergingly narrowing passage 9 thus causes another or secondary division of the metal droplets which were formed in the pulverization chamber 8. This is due to the acceleration and accelerating forces acting on the metal droplets in the passage 9. This is what causes the partial pressure differences mentioned in the range of the convergingly narrowing passage 9 and which result in the bursting of any hollow metal droplets and further disintegration of the same. This effect, furthermore, is obtained at relatively low gas consumption. The convergence of the passage 9 determines the pressure in the pulverization chamber 8 and the acceleration of the metal droplets as well as the resulting break-up forces. The degree of convergence depends on the metal to be pulverized (metal/metal alloy) and on the desired particle size.

What is claimed is:

1. A method of making metal powder by atomizing a metal melt out of a riser, characterized by the following method steps:

(a) mixing of the metal melt with gas, preferably an inert gas, (b) pressurizing the metal melt mixed with the gas by a, preferably inert, pressure gas, forming metal droplets which can in part be hollow, the pressure gas at the same time serving to (c) blow the metal droplets at elevated speed or in accelerated fashion into an expansion chamber, at the same time, forming the finest, solid metal powder.

2. The method as claimed in claim 1, characterized in that the metal melt is mixed with gas, especially inert gas, preferably argon, at the same time, forming a metal froth.

3. The method as claimed in claim 1, characterized in that the metal droplets are blown through a convergingly narrowing passage into an expansion chamber, at the same time, forming the finest metal powder.

4. The method as claimed in claim 1, characterized in that the metal droplets are accelerated by an external pressure gas stream directed into the expansion chamber, at the same time, forming the finest metal powder.

5. The method as claimed in claim 3, characterized in that the metal droplets are blown into the expansion chamber in an oblique upward direction at an angle of from about 10° to 80°, particularly from about 40° to 50° with respect to the horizontal level, at the same time, forming the finest metal powder.

6. An apparatus for making metal powder, especially for carrying out the method as claimed in claim 1, characterized by (a) a receptacle surrounding a melting pot;

(b) a riser disposed above the melting pot and leading out of the receptacle;

(c) a means for lifting the melting pot within the receptacle and/or for lowering the riser such that the latter is immersible in the metal melt;

(d) a gas pressure pipe which opens into the receptacle and through which non-reactive or inert gas can be introduced into the receptacle, at the same time, producing a pressure inside the receptacle to press the metal upwardly inside the immersed riser;

(e) a gas pressure pipe which opens into the riser and through which an inert gas, preferably argon can be admixed to the metal melt rising within the riser, at the same time, especially forming a metal froth;

(f) a pulverization chamber which is connected to the upper end of the riser and into which likewise a gas pressure pipe opens through which gas, preferably inert gas can be blown in at high pressure; and (g) a collecting vessel connected to the pulverization chamber, the passage from the pulverization chamber to the collecting vessel comprising means for accelerating the metal particles.

7. The apparatus as claimed in claim 6, characterized in that the passage from the pulverization chamber to the collecting vessel is of converging configuration.

8. The apparatus as claimed in claim 6, characterized in that apertures open into the passage from the pulverization chamber to the collecting vessel which are approximately uniformly distributed around the circumference of the passage and through which a pressure gas stream can be blown in the direction toward the collecting vessel to accelerate the metal particles in the passage.

9. The apparatus as claimed in claim 6, characterized in that a cover destructible by the metal melt is arranged at the lower end of the riser facing the metal melt.

10. The apparatus as claimed in one of claim 8, characterized in that the passage from the pulverization chamber to the collecting vessel is directed obliquely upwardly at an angle of from 10° to 80°, especially approximately 40° to 50° with respect to the horizontal level.

11. The apparatus as claimed in claim 6, characterized in that the gas pressure pipes each comprise gas pressure regulating valves.

12. The apparatus as claimed in claim 6, characterized in that the receptacle comprises a pressure relief valve or the like.

* * * * *